US005845525A

United States Patent [19]

Widen

[11] Patent Number: 5,845,525

[45] **Date of Patent: *Dec. 8, 1998**

[54] CYLINDER LOCK AND KEY COMBINATION WITH A GUIDING PROFILE RIDGE IN THE LOCK

[76] Inventor: Bo Widen, Box 37, S-644 00, Torsballa, Sweden

[ * ] Notice: The term of this patent shall not extend beyond the expiration date of Pat. No. 5,715,717.

[21] Appl. No.: 366,747

[22] Filed: Dec. 30, 1994

[30] Foreign Application Priority Data

Dec. 30, 1993 [SE] Sweden ..... 9304355

[51] Int. Cl.[6] ..... E05B 27/10

[52] U.S. Cl. ..... 70/493; 70/409; 70/419; 70/420; 70/453

[58] Field of Search ..... 70/347, 356, 419–421, 70/453, 409, 405–407, 493–496, 378

[56] References Cited

U.S. PATENT DOCUMENTS

| | | | |
|---|---|---|---|
| 1,244,450 | 10/1917 | Christoph | 70/406 |
| 2,023,207 | 12/1935 | Olson | 70/409 |
| 3,412,588 | 11/1968 | Schwegler | 70/409 |
| 4,116,025 | 9/1978 | Wolter | 70/409 X |
| 4,356,713 | 11/1982 | Widen | 70/409 X |
| 4,516,416 | 5/1985 | Prunbauer et al. | 70/409 X |
| 4,964,288 | 10/1990 | Braun et al. | 70/409 X |
| 5,421,179 | 6/1995 | Bergström | 70/495 X |

FOREIGN PATENT DOCUMENTS

| | | | |
|---|---|---|---|
| 1135522 | 11/1982 | Canada | 70/409 |
| 2565281 | 12/1985 | France . | |
| 2931653 | 2/1981 | Germany . | |
| 3136314 | 3/1983 | Germany . | |
| 3314511 | 10/1984 | Germany | 70/406 |
| 3314417 | 10/1987 | Germany . | |
| 3817494 | 11/1989 | Germany | 70/493 |
| 4205643 | 8/1993 | Germany . | |
| 9202094 | 1/1994 | Sweden . | |
| WO8704748 | 8/1987 | WIPO . | |
| WO8704749 | 8/1987 | WIPO . | |
| WO8906733 | 7/1989 | WIPO . | |
| WO940643 | 1/1994 | WIPO . | |

*Primary Examiner*—Lloyd A. Gall
*Attorney, Agent, or Firm*—Sughrue, Mion, Zinn, Macpeak & Seas, PLLC

[57] ABSTRACT

A cylinder lock and key combination, wherein the lock comprises a side profile ridge (60) disposed in the key slot (53) and having a relatively shallow recess (61), in which a projection (55) on a side tumbler (54) is vertically movable, and a continuously extending edge portion (62). The key has a relatively shallow coded groove (17), which cooperates with the side tumbler projections (55) of the lock, and a rectilinear, deeper profile groove (16), into which the edge portion (62) of the side profile ridge fits. This unitary edge portion secures a good guidance of the key when the latter is inserted into the lock.

13 Claims, 2 Drawing Sheets

FIG. 1
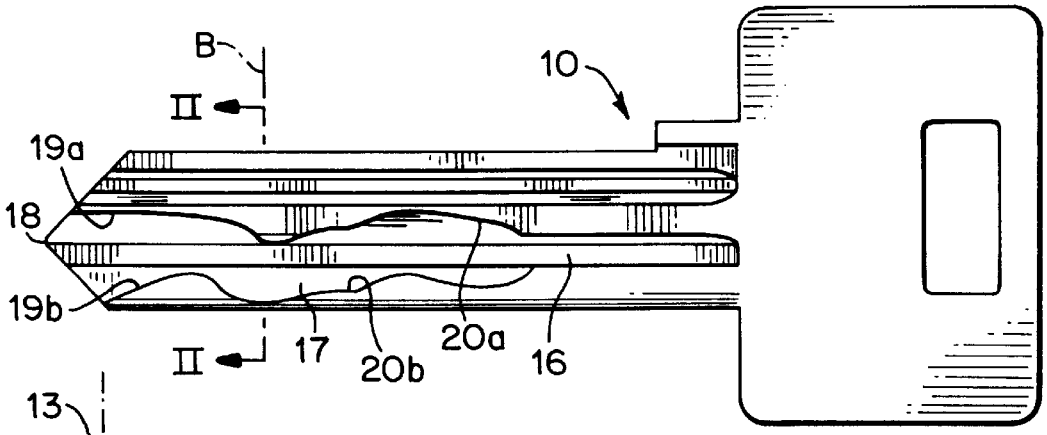
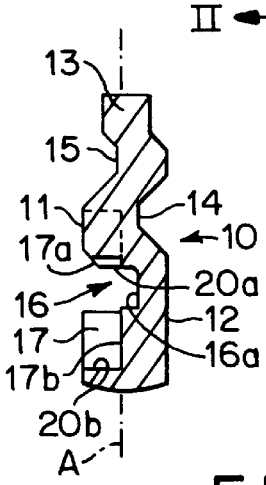
FIG. 2
FIG. 3
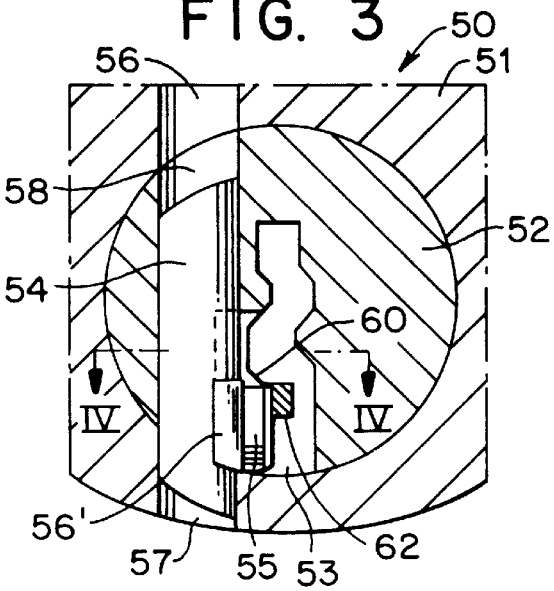
FIG. 5
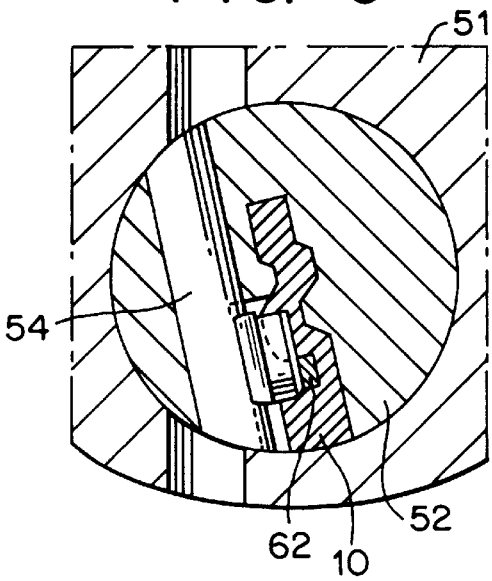
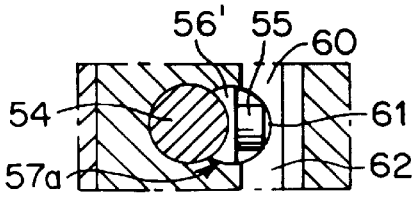
FIG. 4

FIG. 6
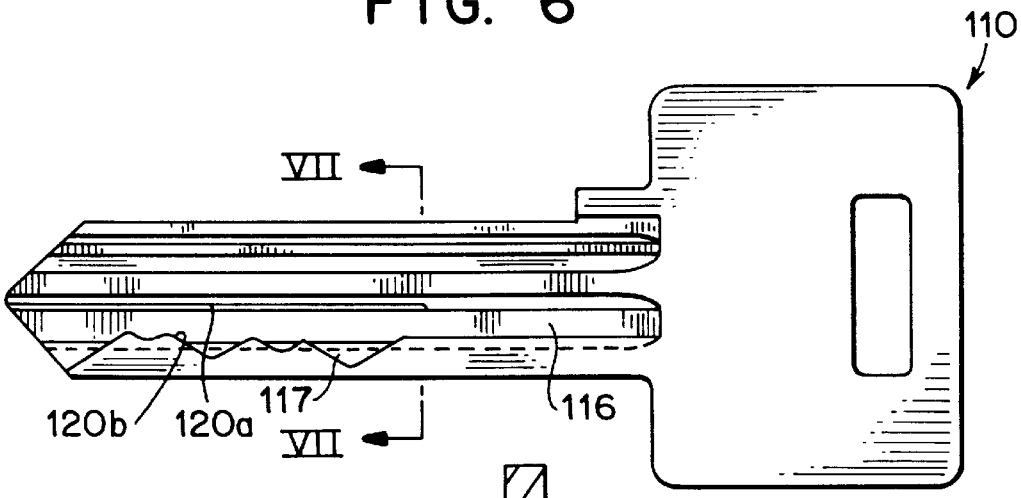
FIG. 7
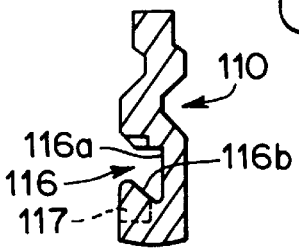
FIG. 8
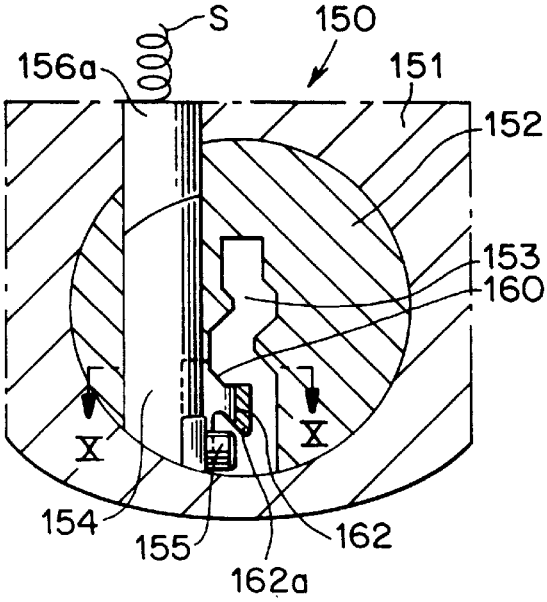
FIG. 9
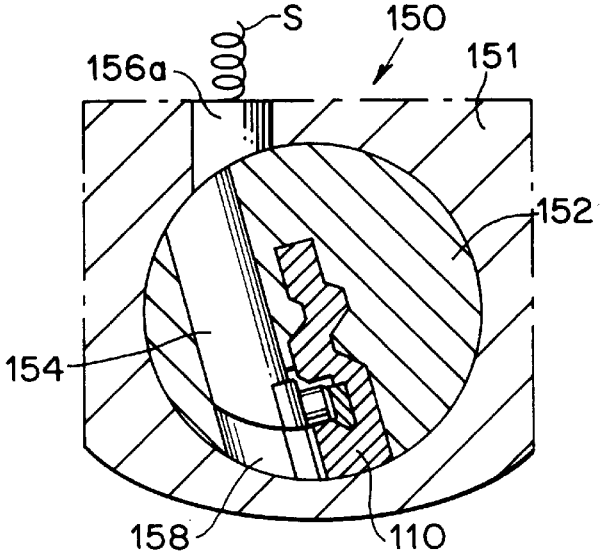
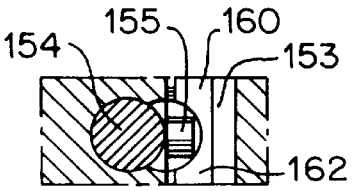
FIG. 10

CYLINDER LOCK AND KEY COMBINATION WITH A GUIDING PROFILE RIDGE IN THE LOCK

BACKGROUND OF THE INVENTION

1. Field of the Invention

The present invention relates to a cylinder lock and key combination. The invention also relates to a corresponding key, a key blank for manufacturing such a key, and a corresponding lock.

2. Description of the Related Art

Lock and key combinations of the kind indicated above are generally known, e.g. from WO87/04749 (Widén Innovation AB). In the known lock, the profile ridge in the key plug is discontinuous in the region of each side tumbler finger. Thus, recesses or openings extend from the associated cavity (where the side tumblers are mounted) transversely into the key slot. In this way, each side tumbler projection (in the form of a finger which is approximately as long as the width of the side profile ridge) is displaceable vertically and/or rotationally while continuously engaging the code pattern of the key blade when the latter is inserted into the key slot of the lock. However, such recesses or openings form interruptions in the profile ridge, so that the guiding action of the latter is impaired. Especially in the case of flat, thin key blades this may cause the front end of the key blade to strike against the edge portion of such a recess or opening upon insertion of the key, in particular if the key blade is inserted somewhat obliquely into the key slot.

A further disadvantage with the previously known lock and key combination is that interruptions in the profile edge make the side tumbler directly accessible to a wider range of lockpicking tools.

SUMMARY OF THE INVENTION

The object of the present invention is to achieve a cylinder lock and key combination of the kind indicated above having an improved guidance of the key in the lock and a higher security against picking.

This object is achieved according to the present invention by providing a cylinder lock and key combination, wherein said cylinder lock comprises a shell; a cylinder key plug rotatably mounted in said shell and including at least one cavity therein; a key slot extending longitudinally in said cylinder key plug for receiving said key; at least one side profile ridge disposed in said cylinder key plug and partially defining said key slot, said side profile ridge including a recess; and at least one side tumbler which is movably mounted in an associated cavity in said cylinder key plug and having a projection which cooperates with said key, when said key is inserted into said key slot. Further, the key comprises an elongated, substantially flat key blade extending between two planar side surfaces, said key blade being insertable into said key slot and having at least one rectilinear side profile groove corresponding to said side profile ridge and extending along an entire length of said key blade in one of said planar side surfaces; at least one coded recess in said one side surface adjacent to said side profile groove, said coded recess cooperating with said projection upon insertion of said key into said key slot of said cylinder lock.

The side profile groove of said key is deeper than said coded recess or recesses adjacent thereto, the depth being calculated transversely to said one side surface. The cavity in the key plug communicates with the key slot of the lock via said recess in said profile ridge while leaving a continuously extending edge portion of said profile ridge, said edge portion guiding said key blade, upon insertion thereof into said key slot, in a region of a bottom of said side profile groove. Furthermore, said projection of said side tumbler extends transversely into said recess in said profile ridge, upon inserting said key blade into said key slot of the lock, so as to make contact with said coded recesses adjacent to said continuously extending edge portion of the side profile ridge of the lock.

The unitary edge portion of the side profile ridge will thus secure a good guidance of the key blade in each position while inserting the same into the lock, even if the key is subjected to oblique forces.

Moreover, the unitary edge portion will protect the side tumblers located inside thereof, especially the projections extending transversely therefrom, so that the side tumblers or the side tumbler projections are not accessible from the side in the region of the side profile ridge.

The recesses of the side profile ridge thus have a limited extension transversely (up to the unitary edge portion) but form openings upwards and/or downwards, so that the side tumbler portions or projections may contact the coded recesses of the key above and/or below the side profile ridge. The side tumblers may be rotatable within limits in the associated cavity, so that said portion or projection (e.g. in the form of a finger) will pivot back and forth, but they also must be movable elevationally, so that the finger portion or projection may follow correspondingly coded recesses of the key, said coded recesses being e.g. wave-like. The side tumblers may alternatively be non-rotatably mounted in the cavities, possibly with side projections which are irregularly distributed along the longitudinal direction of the cylinder key plug (cf. U.S. Pat. No. 5,067,335, Bo Widén). Also, simpler embodiments with centrally located portions or projections on each side tumbler are conceivable.

The side tumblers may lock the cylinder key plug against turning in the shell either individually or in cooperation with at least one side bar or the like.

According to a further aspect of the invention, the side profile groove in the key is undercut at at least one groove surface, wherein the profile ridge of the key plug forms a corresponding tongue in said continuously extending edge portion, said tongue filling up the undercut portion of the side profile groove. Hereby, the edge portion will have a greater extension elevationally and will therefore secure a still higher security against picking, since manipulation of the side tumblers from the side is made even more difficult.

BRIEF DESCRIPTION OF THE DRAWINGS

The invention will be explained further below with reference to the appended drawings illustrating two embodiments.

FIG. 1 is a side view of the key according to a first embodiment of the invention;

FIG. 2 is a cross section of the key along the line II—II in FIG. 1;

FIG. 3 is a cross section through the lock in the region of a side tumbler;

FIG. 4 is a section along the line IV—IV in FIG. 3;

FIG. 5 is a cross section corresponding to FIG. 3 with an inserted key; and FIGS. 6–10 are corresponding views as those of FIGS. 1–5 of a second embodiment of the invention.

DETAILED DESCRIPTION OF PREFERRED EMBODIMENTS

FIGS. 1–5 illustrate a first embodiment of a lock and key combination according to the invention.

The key illustrated in FIGS. 1 and 2 comprises a substantially flat key blade 10, which extends substantially in a central plane A between two mutually parallel side surfaces 11, 12. An upper edge portion 13 is somewhat thinner than the rest of the key blade 10. In the side surface 12 (to the right in FIG. 2) the key blade 10 has a conventional "open" profile groove 14, and in the other side surface 11 (the left in FIG. 2) the key blade has a conventional profile groove 15 as well as a deeper profile groove 16.

According to the invention, this profile groove 16 is substantially deeper (as seen transversely to the central plane A of the key blade) than a coded recess 17 formed adjacent thereto. The profile groove 16 is rectilinear and extends along the whole key blade, as appears from FIG. 1, whereas the shallower coded recess 17 in this case constitutes a wave-like groove consisting of coded side recesses 17*a*, 17*b* in the key blade immediately above or immediately below the deeper profile groove 16.

Adjacent to the pointed front end 18 of the key blade 10, the coded groove 17 has a wide insertion portion defined by a straight upper wall portion 19*a* and a lower, obliquely upwards extending wall portion 19*b*, said insertion portion being gradually narrower up to a cross sectional plane B, wherefrom the coded groove continues in a wave-like manner with mutually substantially parallel opposite wall portions 20*a*, 20*b* extending at a constant distance from each other. The coded groove 17 is relatively shallow, i.e. somewhat less than half the thickness of the key blade 10, and cooperates, upon insertion of the key into the associated lock, with projections 55 extending transversely from side tumblers 54 (cf. FIGS. 3–5).

In FIG. 3, there is shown a cross section of the associated cylinder lock 50, which comprises a shell 51, a cylinder key plug 52 rotatably mounted therein and a key slot 53 extending in the longitudinal direction of the cylinder key plug 52 for receiving the key blade 10.

In the cylinder key plug 52, five of the above mentioned side tumblers 54 are mounted for movement upwards and downwards in respective cavities 58, which adjoin to corresponding recesses 56, 57 in the enclosing shell 51. In the position shown in FIG. 3, the lower end portion of the side tumbler 54 extends into the associated recess 57 and thereby locks the cylinder key plug 52 against rotation in the shell 51.

The above-mentioned, transversely extending projection 55 of the side tumbler 54 is shaped as a pin or tab being elongated vertically and the height of which corresponds to the width of the key code groove 17 between the opposite wall portions 20*a*, 20*b* and the width of which (as seen in the plane in FIG. 4) is substantially less than the diameter of the side tumbler 54. The projection 55 is formed on an adjoining, part cylindrical portion 56' of the side tumbler 54, said part cylindrical portion 56' being guided in a bore 57*a* adjoining the cavity 58 (see FIG. 4). By this configuration, the side tumbler 54 is nonrotatably guided but is movable vertically or elevationally, so that the projection 55 can be displaced predetermined distances elevationally.

When the key blade 10 is inserted into the lock 50, the projection 55 of the respective side tumbler 54 will be positively guided in the coded groove 17 of the key blade between the opposite, mutually substantially parallel wall portions 20*a*, 20*b*. Compare FIGS. 1 and 5. When the key has been fully inserted, each side tumbler 54 assumes a predetermined vertical position, which permits rotation of the cylinder key plug 52 within the shell 51, as illustrated in FIG. 5.

According to the present invention, the cylinder key plug 52 of the lock has a side profile ridge 60, which projects transversely into the key slot 53. In the region of the respective projection 55 of each side tumbler 54, the side profile ridge 60 has a recess 61, which is dimensioned so as to permit the projection 55 to move freely upwardly and downwardly in relation to the side profile ridge 60. The side profile ridge 60 projects so far into the key slot 53, i.e. transversely past the projections 55, that it has a remaining, continuously extending edge portion 62.

Thus, this unitary edge portion 62 extends continuously along the longitudinal direction of the key slot 53 and constitutes a continuous guide and support for the key blade, wherein the edge portion 62 fits into the deepest portion of the side profile groove 16 of the key adjacent to the bottom 16*a* thereof (see FIG. 2).

The second embodiment illustrated in FIGS. 6–10, where corresponding parts have the same reference numerals with the digit 1 added thereto, differs from the preceding embodiment in that the rectilinear profile groove 116 of the key blade is undercut at the lower surface 116*b* thereof. In this case, the profile groove is widened towards the bottom 116*a* of the groove. The side profile ridge of the key plug 152 is correspondingly provided with a downwardly projecting tongue 162*a*, which will fill up the undercut portion of the profile groove 116 upon insertion of the key blade (FIG. 9). In this way, apart from obtaining good guidance of the key, the security against picking will be further enhanced, because the continuously extending portion 162, 162*a* of the profile ridge has a greater vertical extension and will thus make it even more difficult to manipulate the tumblers through the key slot 153.

The coded recess 117 also differs from the preceding embodiment in that the upper groove wall 120*a* is straight, whereas the lower groove wall 120*b* forms a wave-like guiding surface. The side tumbler 154 is in this case spring-biased vertically downwards by means of a spring 5 and an upper pin 156*a* (in the corresponding cylinder bore), and the projection 155, which in this case is substantially cylindrical and therefore has a smaller vertical extension, contacts the groove wall 120*b* resiliently when the key blade is inserted into the lock.

The side tumblers may alternatively be oriented obliquely or perpendicularly in relation to the key slot and may cooperate, with an end portion, directly with the coded recess of the key. In such a case, the side tumblers may be, e.g., cylindrical and being without any projections extending transversely from the cylindrical surface.

It is contemplated that numerous modifications may be made to the cylinder lock and key of the present invention without departing from the spirit and scope of the invention as defined in the following claims.

What is claimed is:

1. A cylinder lock and key combination, wherein the lock (50) comprises:

a shell (51);

a cylinder key plug (52) rotatably mounted in said shell and including at least one cavity (58) therein;

a substantially flat key slot (53) extending longitudinally in said cylinder key plug for receiving said key;

at least one side profile ridge (60) disposed in said cylinder key plug and projecting transversely into said key slot, said side profile ridge including an adjoining recess (61); and at least one side tumbler (54) which is movably mounted in an associated cavity (58) in said cylinder key plug and having a projection (55) which cooperates with said key, when said key is inserted into said key slot, said at least one side tumbler (54) being movable one of vertically and obliquely when the key is inserted into said key slot, said cavity (58) communicating with said key slot (53) via said adjoining recess (61) in said profile ridge (60), said recess (61) being dimensioned to accommodate said projection (55) of said at least one side tumbler (54) while permitting said one of vertical and oblique movement thereof; and wherein said key comprises:

an elongated, substantially flat key blade extending between two planar side surfaces (11, 12), said key blade being insertable into said key slot and having at least one rectilinear side profile groove (16) corresponding to said side profile ridge and extending along an entire length of said key blade in one of said planar side surfaces;

an elongated, longitudinally extending wave-like key code groove **(17*a*, 17*b*) in said one side surface adjacent to said side profile groove, said wave-like key code groove (17*a*, 17*b*) cooperating with said projection (55) of said at least one side tumbler (54) and causing said projection (55)** to move one of vertically and obliquely upon insertion of said key into said key slot of said cylinder lock;

wherein said side profile groove (16) of said key blade is substantially deeper than said wave-like key code groove adjacent thereto, the depth being calculated transversely to said one side surface and the deepest portion thereof serving as a guiding bottom portion **(16*a*)**;

wherein said profile ridge has a continuously extending, unitary edge portion (62) serving to guide and support said key blade, upon insertion thereof into said key slot, while engaging with said guiding bottom portion **(16*a*) of said side profile groove (16); and wherein said recess (61) in said profile ridge (60) is located transversely inside said unitary edge portion (62) so as to protect said projection (55) against manipulation and to permit movement of said projection (55)** one of vertically and obliquely therein when inserting said key blade into said key slot of the lock.

2. The combination according to claim 1, wherein said recess (61) in said profile ridge (60) extends into openings upwards and downwards into said key slot (53).

3. The combination according to claim 1, wherein the side profile groove of the key is undercut at at least one groove surface, wherein said side profile ridge of said cylinder lock has a tongue corresponding to the undercut portion of the side profile groove.

4. The combination according to claim 3, wherein said at least one side tumbler is spring biased in said cavity, said projection of said at least one side tumbler cooperating with said wave-like key code groove of said key above or below said side profile ridge of said cylinder lock.

5. The combination according to claim 1, wherein said at least one side tumbler is freely movable elevationally in said cavity, said projection of the at least one side tumbler being positively guided in said wave-like key code groove of said key.

6. A key comprising:

an elongated, substantially flat key blade (10), extending between two planar side surfaces (11, 12), said key blade being adapted to be inserted in a key slot of a lock and having at least one rectilinear side profile groove (16) corresponding to a side profile ridge projecting into the key slot of the lock and extending along an entire length of said key blade in one of said planar side surfaces; and an elongated, longitudinally extending wave-like key code groove (17) in said one planar side surface adjacent to said side profile groove, said wave-like key code groove (17) being adapted to cooperate with a projection (55) of a side tumbler (54) in the lock upon insertion of the key in the key slot of the lock, wherein said side profile groove (16) of said key is substantially deeper than said wave-like key code groove (17) adjacent thereto, the depth being calculated transversely to said one planar side surface and the deepest portion thereof serving as a guiding bottom portion **(16*a*) for guiding the key blade while engaging with a continuously extending, unitary edge portion (62)** of said side profile ridge.

7. The key according to claim 6, wherein said wave-like key code groove (17) adjoins the deeper side profile groove (16) at an upper or lower side of said side profile groove (16).

8. The key according to claim 6, wherein said wave-like key code groove (17) has opposite, mutually substantially parallel groove walls **(20*a*, 20*b*), between which the projection (55) of the side tumbler (54) is positively guided upon insertion of said key into the lock, and wherein a width of the wave-like key code groove (17), which is defined by a distance between said opposite groove walls (20*a*, 20*b*), is greater than a width of the deeper side profile groove (16)**.

9. The key according to claim 6, wherein said side profile groove (16) has a substantially rectangular profile cross section.

10. The key according to claim 6, wherein said side profile groove is undercut at at least one groove surface.

11. The key according to claim 10, wherein said side profile groove is widened inwardly towards the bottom.

12. A lock comprising:

a shell (51);

a cylinder key plug (52) rotatably mounted in said shell;

a substantially flat key slot (53) extending longitudinally in said cylinder key plug and adapted to receive a substantially flat key blade of an associated key;

at least one side profile ridge (60) disposed in the cylinder key plug and projecting transversely into said key slot, said side profile ridge including an adjoining recess (61); and at least one side tumbler (54) which is movably mounted in an associated cavity (58) in said cylinder key plug and having a projection (55) which cooperates with the associated key when the key is inserted into said key slot, said at least one side tumbler (54) being movable one of vertically and obliquely in relation to the key when the key is inserted into said key slot, said cavity (58) communicating with said key slot (53) via said adjoining recess (61) in said profile ridge (60), said recess (61) being dimensioned to accommodate said projection (55) of said at least one side tumbler (54) while protecting said protection against manipulation and permitting said one of vertical and oblique movement thereof, wherein said profile ridge has a continuously extending, unitary edge portion (62) serving to guide and support the key blade, upon insertion of the key blade into said key slot, while engaging with a bottom portion (16*a*) of a side profile groove (16) of the key blade; and wherein said projection (55) of said at least one side tumbler (54) extends transversely into said recess (61) in said profile ridge (60), and being one of vertically and obliquely movable inside said unitary edge portion when inserting the key blade into said key slot of the lock, while making contact with an elongated, longitudinally extending wave-like key code groove of the key.

13. The lock according to claim 12, wherein said unitary edge portion (62) of the side profile ridge (60) has a tongue corresponding to an undercut portion of the side profile groove of the key blade.

* * * * *